United States Patent [19]

Wanke

[11] Patent Number: 4,932,115

[45] Date of Patent: Jun. 12, 1990

[54] PROCESS FOR APPLYING A NON-METALLIC ROLLER COATING

[76] Inventor: Wilhelm Wanke, Donauschwabenstrasse 47, D-7920 Heidenheim, Fed. Rep. of Germany

[21] Appl. No.: 211,363

[22] Filed: Jun. 24, 1988

[30] Foreign Application Priority Data

Jun. 24, 1987 [DE] Fed. Rep. of Germany ..... 3720800

[51] Int. Cl.[5] ..... B31D 39/00

[52] U.S. Cl. ..... 29/452; 29/127; 29/130; 29/460; 427/388.1

[58] Field of Search ..... 156/162, 165, 184, 171, 156/294; 29/131, 132, 446, 148.4, 127, 130, 452, 460; 427/385.5; 101/328

[56] References Cited

U.S. PATENT DOCUMENTS

| | | | |
|---|---|---|---|
| 111,449 | 1/1871 | Greacen, Jr. et al. | 29/127 |
| 1,232,053 | 7/1917 | Lawrence | 29/127 |
| 2,312,853 | 3/1943 | Toland et al. | 29/131 |
| 2,369,635 | 2/1945 | Bacon | 29/130 |
| 4,144,813 | 3/1979 | Julian | 29/129.5 X |

*Primary Examiner*—Michael W. Ball
*Assistant Examiner*—Michele K. Yoder
*Attorney, Agent, or Firm*—Davis, Bujold & Streck

[57] ABSTRACT

In a process for applying a non-metallic roller coating to the body of a roller, especially for paper machines, a stretch inset (20, 31, 32) with mechanical prestress is applied to the body (10) or to a contact surface (12) of said body but the stretch insert is applied without bonding to said body (10) or to the contact surfaces thereof. A bonding surface is created between the stretch insert (20, 31, 32) and the roller coating (40).

2 Claims, 2 Drawing Sheets

Fig.1
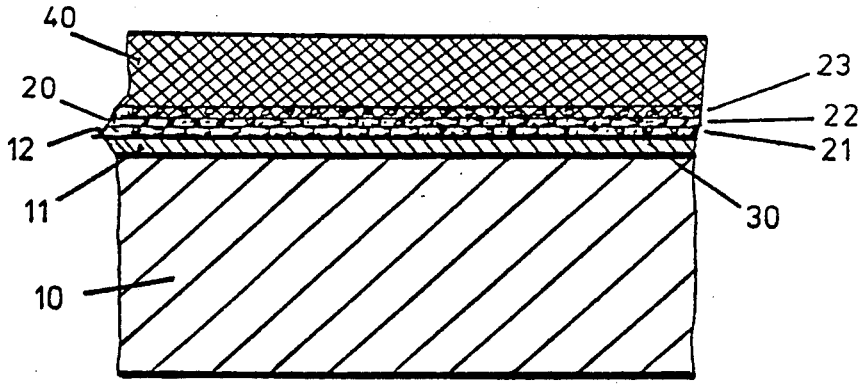
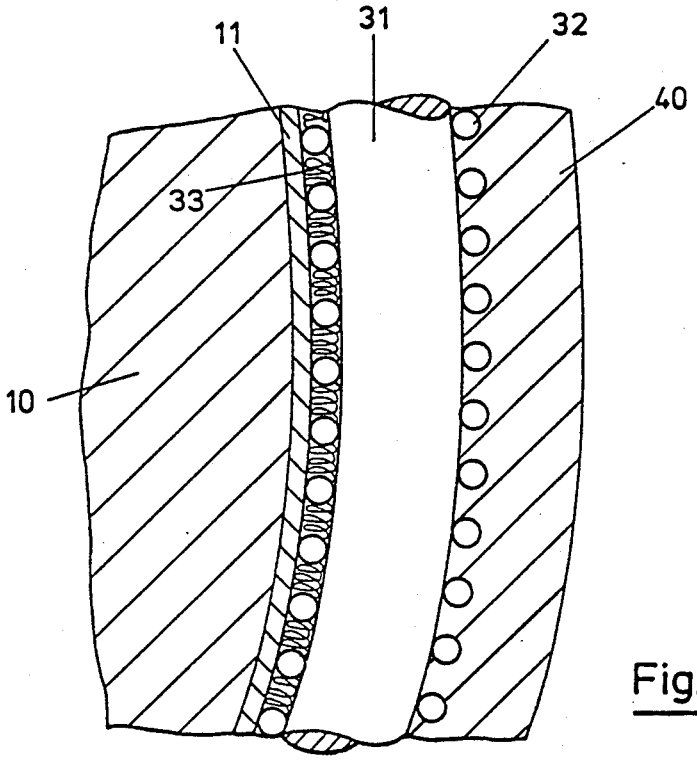
Fig. 3

PROCESS FOR APPLYING A NON-METALLIC ROLLER COATING

The invention concerns a process for applying a non-metallic roller coating to the body of a roller, especially for press rollers of paper machines.

Plenty of press rollers are known from the utilization of industrial practice. Mainly in production plants for the manufacture of paper and cardboard, the use of press rollers are very often found in which one or more of the press rollers are provided with a non-metallic roller coating.

Such non-metallic roller coatings are in part used for quality requirements, but in most cases the reason for their use is mainly for mechanical advantages. The advantages are, for instance, chemical resistance, the reduction of mechanical wear of the surrounding parts such as the press felt, the reduction of vibrations and others. Therefore, a number of advantages justify that special developments be devised in the kinds of material and also in the processes for producing non-metallic roller coatings.

In relation to the kinds of material, special materials known by the general expression of polyurethane have been lately used, for instance, together with the common conventional kinds of rubber. The former are especially used because of their good shape stability, for instance, in press rollers having drainage grooves in the roller coating.

In the processes for the manufacture of non-metallic roller coatings, the work exclusively has been carried out formerly by firmly bonding the non-metallic roller coating to the body of the press roller. In the non-metallic roller coating itself, it has been sought to increase the strength of the non-metallic roller coating by modifications of layer arrangements and/or chemical bonding supports with partially added support due to mechanical prestressing, such as by integrated shrinking fabrics.

However, the production speed in plants where such press rollers are used has greatly increased in the last years. From this results an increase in stress due to milling work in non-metallic roller coatings, which stress in most cases exceeds the possible limits of the non-metallic roller coatings. Press rollers reinforced with metallic coatings of stainless steel or bronze came to be used with all the known disadvantages for the products to be manufactured and for the surroundings and wear conditions. It is especially for these situations that a non-metallic roller coating, which can withstand the mechanical stresses that occur, is very desirable.

For solving said problems, tests have been carried out using, a circular strap with equal values in material, instead of the non-metallic roller coating. Said strap was kept extremely short in order not to impair the neighboring area. German DE-OS No. 36 32 694 has disclosed such a short strap having only one additional guide roller.

In DE-OS No. 17 86 367, a still shorter strap has been shown which is placed in an inverted position over the body of the press rollers as a loose hose with a somewhat larger diameter. Both designs can be used at low speeds, preferably with only short intervals of operation. But they are not suited for continuous operation with medium or high production speeds, since the lateral guides additionally required with respect to a firm roller coating are not sufficient for the situations that arise in this case.

Since in the surface area, for instance, polyurethane and some other coating materials fully meet the mechanical conditions mentioned, this invention is based on the problem of providing a process for producing or applying to a roller body a non-metallic roller coating of materials already known or optionally, a new coating material, whereby the stress of the non-metallic roller coating that results from milling work is substantially reduced.

The process for producing or applying a non-metallic roller coating according to the invention solves the stated problem by applying a stretch insert with mechanical prestress to the body or to a contact surface of the body without bonding directly to the body or to the contact surface therof, and producing between said stretch insert and the roller coating a bonding surface.

According to the invention, the former chemical steps are combined and are optionally replaced, in part, by at least one mechanical component, namely a stretch insert as an intermediate layer. This leads to the reduction of stress in the non-metallic roller coating due to milling work in the case of pressing loads.

The non-metallic roller coating receives an integrated stretch insert instead of firmly bonding to the body of the press roller. The integrated stretch insert or a stretch fabric is situated on the side of the non-metallic roller coating that faces the body of the press roller. The outer side of the integrated insert is bonded with the coating material of the non-metallic coating by an adhesive bonding. The inner side of the integrated stretch insert rests, with preferably mechanical prestress, on the contact surface of the body of the press roller.

One of the main purposes of the process according to the invention for producing a non-metallic roller coating is that by virtue of the integrated stretch insert, a bonding surface does not result, or only partially results, through and/or with the contact surface of the body of the press roller and the non-metallic roller coating. Particularly in the area of the zone with subsequent pressure load, it is advantageous to have absolutely no adhesive bonding of the above described kind.

Differential movements in the microarea in fact are not possible due to the stretch insert.

On the other hand, in many cases, especially when the subsequent place of utilization is in the wet area of paper machines, it is recommendable to have a full bonding adhesive material of the above described kind in the marginal area of the non-metallic roller coating, preferably outside the zone of subsequent pressure load. The latter, for instance, in order to install a moisture suppressor in an axial direction or on the front sides of the roller.

To be able to accomplish these combinations, it is provided in another embodiment of the process according to the invention to cover the inner surface of the stretch fabric with fillers that prevent adhesive bonding of the integrated stretch fabric and of the contact surface of the body of the press roller, which contact surface preferably consists of wear-resistant material.

Said fillers preferably must also solve two more problems:

(a) minimize or completely prevent disturbing air pockets due to filling;

(b) have low resistance to shearing forces with the result that no forces, or only minimal forces, stand opposed to the movements in the microarea.

As a further complement to the safety of operation, a multi-layered integrated stretch insert can be optionally provided with the installation of the integrated stretch insert to optimize the mechanical components or to increase the stability thereof. In the case of three layers, for instance, the inner layer has a very strong mechanical tension toward the contact surface of the body of the press roller. The central layer with low mechanical prestress is provided in the microarea for differential movements, while the outer layer has a stable, firm adhesive bonding surface with the coating material of the non-metallic roller coating.

Therefore, by varying the design construction of the integrated stretch insert, the mechanical component can be optimized for each case in which it is needed. The above described difference of mechanical tension of the individual layers of the integrated stretch insert is easily attained when the mechanical tension is introduced by thermal action in a manner already known.

Instead of a stretch fabric, it can also be provided in another embodiment of the invention that the stretch insert be formed by a tension wire wound on the contact surface of the body. The external periphery of said tension wire having a helically or trapezoidally grooved surface, or a wrapping wire can likewise be wound on the tension wire itself. The windings here can be close to each other or spaced apart from each other and be helically shaped.

To obtain an adequately rough surface and good bonding surface with the non-metallic roller coating, there can be further provided that the wound wire itself be also helically wrapped with smaller diameter wire, preferably of helical shape.

This has the added advantage that on the inner side of the stretch insert formed by the wound wire, which is formed by helically winding a wrapping wire on the tension wire and then winding the wrapped tension wire on the contact surface, acts on the contact surface of the body of the press roller like numerous micro-roller bearings and can thus better absorb forces and movements.

When the wrapping wire is helically wound in a manner such that there is a space between the individual windings, the vacant space between the contact surface of the body and the tension wire can be filled with a filler so that no bonding or glueing with the body of the press roller results in this area.

Two embodiments of the invention are basically described herebelow with reference to the drawing.

In the drawing:

FIG. 1 is a first embodiment of a non-metallic roller coating with a stretch fabric as a stretch insert;

FIG. 3 is a detailed enlargement of a tension wire with a wrapping wire.

Figure 2:
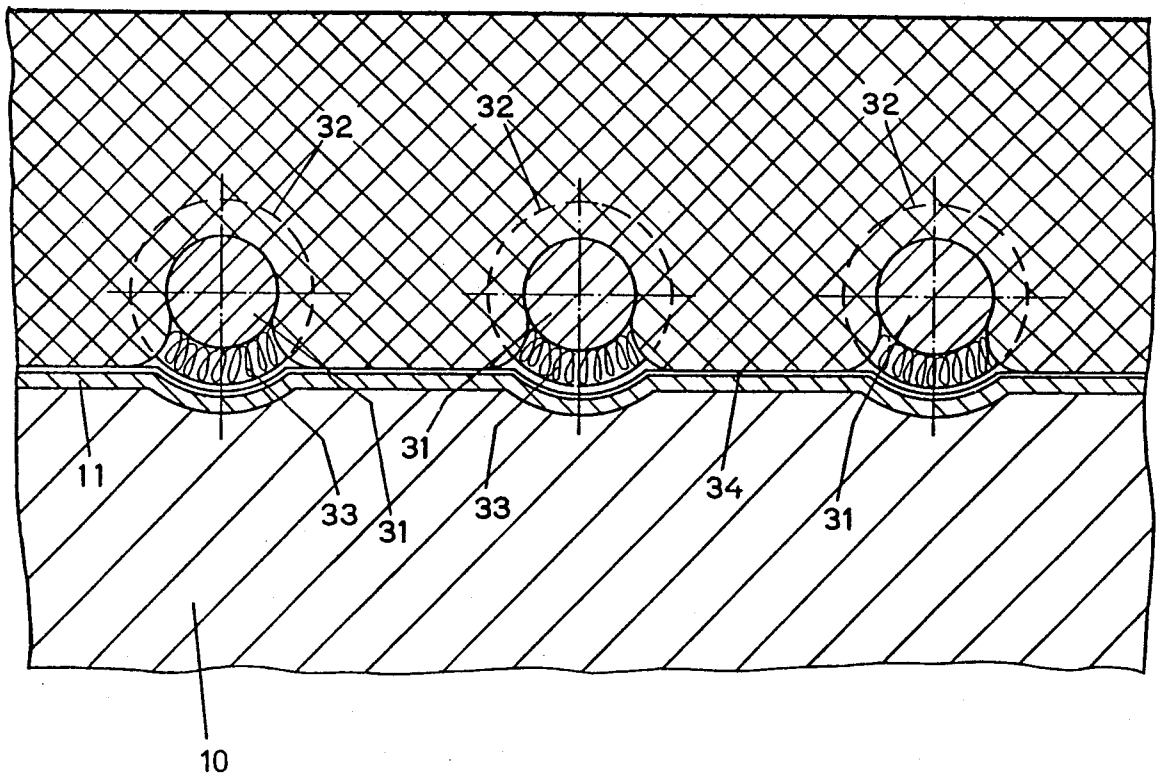
FIG. 2 is another embodiment of a non-metallic roller coating with a tension wire as a stretch insert.

The body 10 of a press roller has a coating 11 of wear resistant material that forms a contact surface 12 for the non-metallic roller coating. According to FIG. 1, a stretch fabric 20 that is shown in the drawing as three-layer stretch insert namely inner layer 21, central layer 22 and outer layer 23, is placed over said contact surface 12. In the area of the inner layer 21 and the central layer 22 of the integrated stretch fabric 20, fillers 30 are seen in order to prevent bonding to the body 10. The coating material 40 of the non-metallic roller coating can be designed as one-layer, or multi-layered if desired, and it reaches into the area of the outer layer 23 of the integrated stretch fabric 20 and creates, with the latter, a firm bonding surface for producing a non-metallic roller coating according to the invention.

The firm bonding surface between the non-metallic roller coating and the stretch insert can, in a simple manner, take place directly when applying the roller coating to the body 10 of the press roller, and specifically depends on the kind of the roller coating. If the roller coating is made, for instance, of rubber or of a rubber-like material, then it is vulcanized and material accordingly penetrates in the outer layer 23 of the stretch fabric 20 during the vulcanization.

If a synthetic material such as polyurethane is used as a roller coating, then bonding to the outer layer 23 is likewise obtained during the pouring.

FIGS. 2 and 3 show an embodiment wherein the stretch insert is formed by a tension wire 31 which is helically wound on the body 10 of the press roller with a small space between each of the individual windings. The tension wire 31 itself is additionally provided with a wrapping wire 32 which likewise is helically wound about the tension wire 31, and the individual windings are also spaced from each other. This development can be seen in FIG. 3 where only a small part of the periphery of the body 10 is shown. As can be seen, the wrapping wire 32, which is clearly of a lesser diameter than the tension wire 31, imparts to the outer side a rough surface such that the roller coating 40, when applied, penetrates into the interspaces between the individual winding plies, thus bridging therewith a firm bonding which is pratically sustained by a positive locking.

On the opposite side, that is, on the side contacting the contact surface 12 of the body 10, the interspace between the individual windings of the wrapping wire 32 is filled with a filler 33. Between the individual windings or coilings of the tension wire 31, on the side facing the body 10, a material 34 can likewise be applied as a contact or bonding suppressor so than no adhesion can occur before vulcanization.

Instead of wrapping the tension wire 31 with the wrapping wire 32, for adherence to the roller coating 40, it is also possible to provide the outer periphery of the tension wire itself with a helically or trapeziodally grooved surface.

I claim:

1. A process for applying a non-metallic roller coating to a contact surface of a roller comprising applying a stretch insert under a mechanical pre-stress to the contact surface without adhesive bonding of the stretch insert to that surface and then applying said non-metallic roller coating to the exterior of the stretch insert to produce a coating which penetrates the stretch insert and is adhesively bonded to the stretch insert without being adhesively bonded to the contact surface, wherein said stretch insert is a tension wire about which is wound a wrapping wire of a smaller diameter than the tension wire, the wrapped tension wire being wound about said contact surface.

2. A process according to claim 1 herein a filler is introduced between the stretch insert and the contact surface and extends into the interstices between the wrapped tension wire forming the stretch insert.

* * * * *